United States Patent [19]

Stormont

[11] 3,954,418

[45] May 4, 1976

[54] CATALYTIC CONVERTER WITH BYPASS

[75] Inventor: James D. Stormont, Grass Lake, Mich.

[73] Assignee: Tenneco Inc., Racine, Wis.

[22] Filed: Sept. 27, 1972

[21] Appl. No.: 292,495

[52] U.S. Cl. ..... 23/288 FA; 60/288; 60/299

[51] Int. Cl.[2] ..... B01J 8/02; F01N 3/15; F01N 7/00

[58] Field of Search ..... 23/288 F, 288 FA; 60/287, 288, 290, 299

[56] References Cited

UNITED STATES PATENTS

| | | | |
|---|---|---|---|
| 1,766,945 | 6/1930 | Riehm | 23/288 F |
| 3,024,593 | 3/1962 | Houdry | 23/288 F |
| 3,090,677 | 5/1963 | Scheitlin et al. | 23/288 F |
| 3,094,394 | 6/1963 | Innes et al. | 23/288 |
| 3,201,206 | 8/1965 | Wawrziniok | 23/288 F |
| 3,201,207 | 8/1965 | Lentz | 23/288 F |
| 3,252,767 | 5/1966 | Lentz | 23/288 F |
| 3,260,566 | 7/1966 | Fisher | 23/288 F |
| 3,297,400 | 1/1967 | Eastwood | 23/288 F |
| 3,645,098 | 2/1972 | Templin et al. | 23/288 F |
| 3,695,851 | 10/1972 | Perga | 23/288 F |
| 3,740,197 | 6/1973 | Scheitlin et al. | 23/288 F |
| 3,776,275 | 12/1973 | Updike | 60/288 |
| 3,809,539 | 5/1974 | Balluff et al. | 60/288 |
| 3,820,328 | 6/1974 | Garcea | 23/288 F X |

FOREIGN PATENTS OR APPLICATIONS

| | | | |
|---|---|---|---|
| 1,216,496 | 4/1960 | France | 60/288 |
| 1,223,709 | 8/1966 | Germany | 60/288 |

*Primary Examiner*—Barry S. Richman
*Assistant Examiner*—Bradley R. Garris
*Attorney, Agent, or Firm*—Harness, Dickey & Pierce

[57] ABSTRACT

A catalytic converter for the exhaust gas of an internal combustion engine has an internal by-pass structure in which the position of a bed temperature responsive valve determines whether inlet gas will flow through or around the catalyst bed.

6 Claims, 4 Drawing Figures

CATALYTIC CONVERTER WITH BYPASS

BRIEF SUMMARY OF THE INVENTION

It is the purpose of the invention to provide an internal by-pass structure for a catalytic converter.

The invention accomplishes this purpose by means of an inlet chamber that receives all incoming exhaust gas and which has bed-flow and by-pass flow outlets controlled by a bed temperature responsive valve.

DETAILED DESCRIPTION OF THE INVENTION

Figure 1:
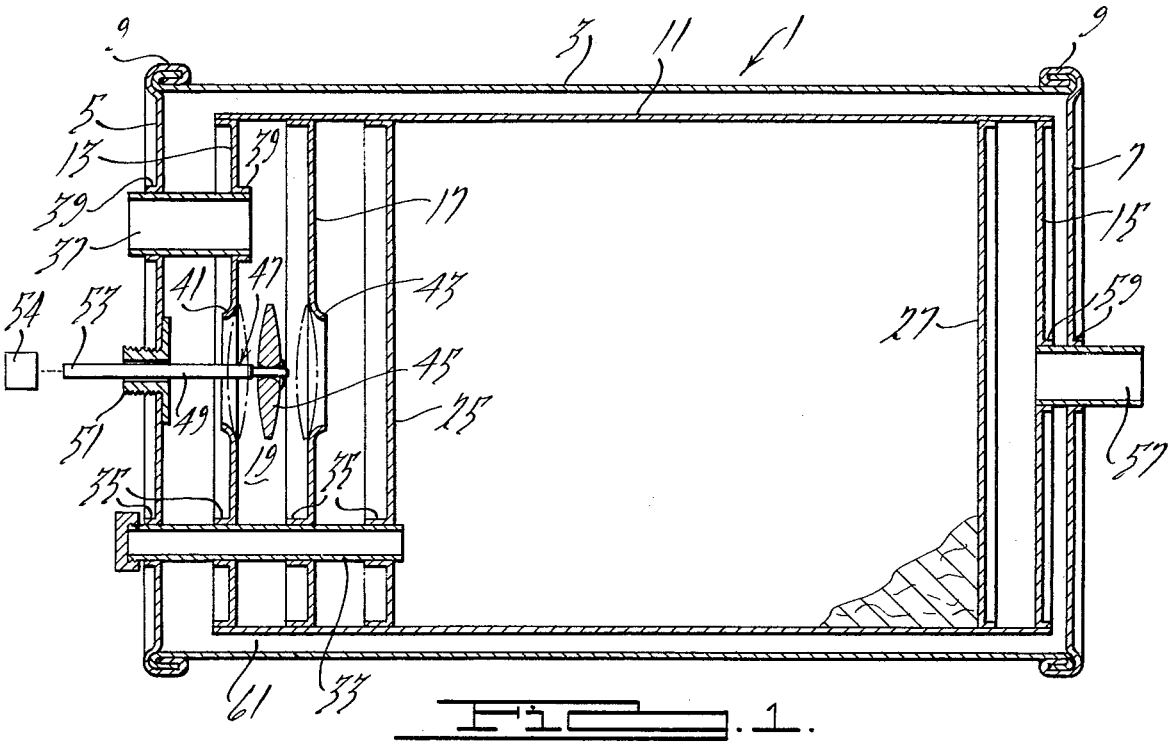
FIG. 1 is a horizontal cross section on a midplane through a catalytic converter embodying the invention, the converter being of the type disclosed and claimed in a copending U.S. application Ser. No. 234,009, filed Mar. 13, 1972, (now U.S. Pat. No. 3,809,539) of Robert N. Balluff and James D. Stormont, entitled "Downflow Catalytic Converter, " and assigned to the assignee hereof.
Figure 2:
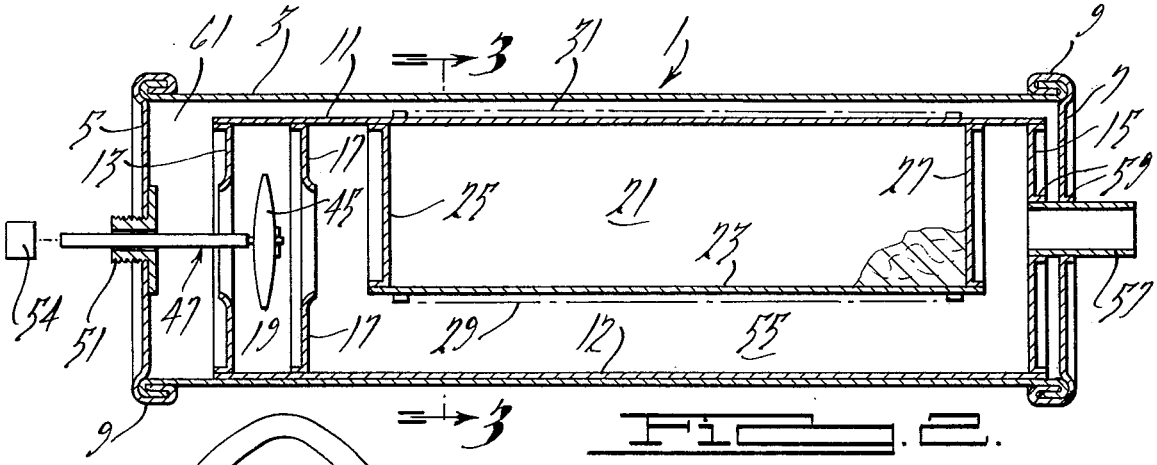
FIG. 2 is a vertical cross section on a midplane through the converter of FIG. 1.
Figure 3:
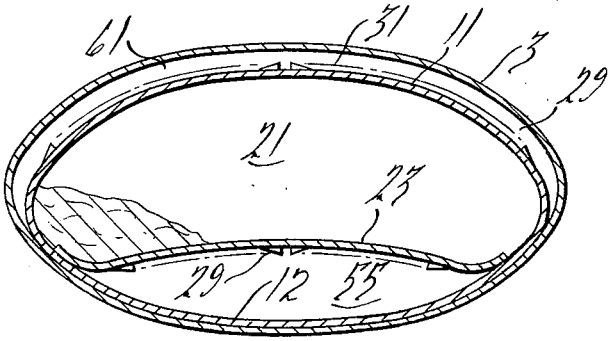
FIG. 3 is a cross section along the line 3—3 of FIG. 2.
Figure 4:
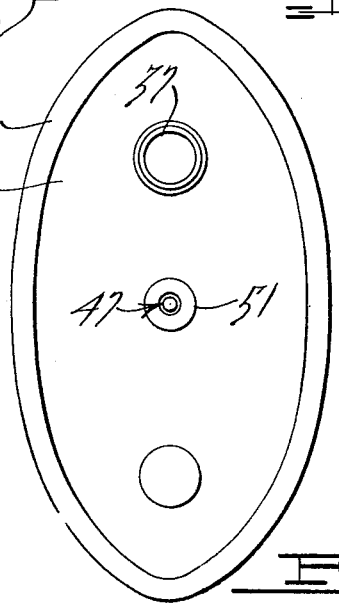
FIG. 4 is an end elevation taken from the left or inlet side of the converter as shown in FIGS. 1 and 2.

The catalytic converter 1 has an oval outer shell 3 which is closed at opposite ends by an inlet header 5 and an outlet header 7, respectively, which are interlocked with it in fluid tight joints 9. Supported inside of the outer shell 3 is a slightly smaller oval inner shell 11 which has a bottom portion 12 that rests on the inside of the bottom of the outer shell 3 as seen best in FIG. 3. The inner shell is closed at opposite ends by a flanged inlet header 13 and a flanged outlet header 15 which are illustrated as welded inside the ends of the shell. Additionally, there is a flanged partition 17 welded inside the shell 11 adjacent the inlet header 13 and defining with it an inlet chamber 19. A catalyst bed 21 is defined inside the inner shell 11 by a transversely curved longitudinally extending bed support partition 23 which acts with a portion of the shell 11 (FIG. 3) to form the transversely downwardly curved shape of the bed. The opposite ends of the bed are closed by flanged partitions 25 and 27 which are welded to the bottom bed support 23. The bottom partition 23 and that part of the inner shell 11 located above it are louvered as seen at 29 and 31 to provide, respectively, outlet and inlet openings for gas to flow through the bed 21, the bed containing suitable particulate catalyst material. A capped filler tube 33 (FIG. 1) is supported in aligned necks 35 in header 5, header 13, partition 17, and partition 25 and opens at its inner end and outside of the converter to provide a means to refill the bed.

An inlet tube 37 for exhaust gas is supported in aligned necks 39 in inlet headers 5 and 13 to open into the inlet chamber 19. The inlet header 13 and the partition 17 have aligned flanged openings 41 and 43 providing seats for the valve heat 45 of a thermovalve member 47, the stem 49 of which is slidably supported in a bushing 51 mounted in the inlet header 5. Opening 41 permits flow through the bed 21 while opening 43 permits bypass flow around the bed. The outside end 53 of the stem 49 is operated through suitable circuitry and operating means 54 which includes means for sensing the temperature of bed 21, such as a thermister, and to the ignition circuit for the internal combustion engine. When the engine is off or when the temperature of the bed exceeds a predetermined temperature, e.g. 1800° F., the valve head 45 will seat on inlet header 13 to cover opening 41 and provide for bypass flow through opening 43. On engine start up or after the bed reaches a desired minimum temperature, the valve 45 will be shifted to seat on partition 17 and close opening 43 so that flow is through opening 41.

The space inside of inner shell 11 between the partition 17 and outlet header 15 comprises a combination bypass and bed outlet flow passage or chamber 55. The opening 43 connects it to inlet chamber 19 for bypass flow and the louvers 29 in partition 23 connect it to the bed 21 to receive outlet flow from the bed. The chamber 55 empties into an outlet tube 57, that is supported in aligned necks 59 in the outlet headers 7 and 15, which conducts gas out of the converter where ordinarily it enters a tailpipe (not shown) in the exhaust system.

The space inside of the outer shell 3 between it and the inner shell 11 comprises an inlet passage 61 connecting the opening 41 to the louvered openings 31 in inner shell 11 that form the inlet to bed 21. Thus, when the converter is operative and valve head 45 covers opening 43, inlet gas from inlet tube 37 enters inlet chamber 19, exits the chamber through opening 41, flows through space 61 to the bed inlet openings 31, passes through the catalyst in bed 21 where undesired emissions undergo chemical changes, and the treated gas leaves the bed through openings 29 in partition 23 to enter chamber 55 from which it leaves the converter via outlet tube 57.

When the converter is inoperative, the valve head covers opening 41 and inlet gas flows directly into chamber 55, bypasses the bottom of bed 21, and leaves the converter via outlet tube 57.

Modifications in the specific structure shown may be made without departing from the spirit and scope of the invention.

I claim:

1. A catalytic converter comprising a tubular outer housing having inlet means and outlet means for a gas stream to be purified, an inner housing including catalyst bed means providing a catalyst bed in said inner housing and having a perforate inlet wall and a perforate outlet wall, gas to be purified flowing from the inlet wall to the outlet wall through the catalyst bed, inlet chamber means in said inner housing forming an inlet chamber, said inlet means opening into said inlet chamber, said inlet chamber means having first and second openings therein for gas to leave the inlet chamber, inlet gas passage means in the outer housing for the passage of gas from the first of said inlet chamber openings to said perforate inlet wall, outlet gas passage means in said outer housing for the passage of gas from said perforate outlet wall and from the second of said openings in the inlet chamber to said outlet means, and flow control means responding to the temperature of the catalyst bed including a valve means having a first position wherein it closes the first opening in said inlet chamber and opens the second opening thereby causing said gas stream to by-pass said catalyst bed and to flow directly from said inlet chamber to said outlet gas passage means and a second position wherein it closes the second opening in said inlet chamber and opens the first opening, said first and second openings being rectilinearly aligned and said valve means including a single valve head having two valve faces thereon and rectilinearly movable to close said openings.

2. A converter as set forth in claim 1 wherein said valve means includes a stem attached to said valve head and extending to the outside of said converter.

3. A converter as set forth in claim 1 including a pair of spaced parallel partitions in said inner housing defining said inlet chamber, one of said openings being in one of said partitions and the other of said openings being in the other of said partitions.

4. A catalytic converter comprising a tubular outer housing having inlet means at one end and outlet means at the other end for a gas stream to be purified in the converter, an inner tubular housing separate from and inside of said outer housing, partition means in the inner of said housings forming an inlet chamber, said inlet means opening into said inlet chamber, means forming a catalyst bed inside said inner housing, said catalyst bed having a perforate outlet wall opening inside of said inner housing, a portion of said inner housing being perforate and said portion forming an inlet wall for said catalyst bed, outer gas passage means inside said outer housing and outside said inner housing connecting said inlet wall to said inlet chamber, said outlet means opening into said inner housing, and outlet gas passage means inside the inner housing connecting said outlet wall to said outlet means, said inlet chamber having an outlet opening into said outlet gas passage means, and flow control means including a valve means located inside the inner housing, said valve means being rectilinearly movable and supported in said partition means, said inlet chamber having a second outlet opening into said outer gas passage means and in rectilinear alignment with the first mentioned outlet opening, said valve means having a first position wherein it closes the second outlet opening on said inlet chamber and opens the first outlet opening thereby causing said gas stream to by-pass said catalyst bed and to flow directly from said inlet chamber to said outlet gas passage means and being operative to control flow respectively through each of the outlet openings.

5. A catalytic converter comprising an elongated tubular oval outer housing having a longitudinal axis and opposite end walls respectively with inlet means and outlet means for a gas stream to be purified, an inner housing including catalyst bed means providing a catalyst bed in said inner housing and having a perforate inlet wall and a perforate outlet wall, said bed having a curved concave-convex shape with the outside of the inlet wall being convex and the outside of the outlet wall being concave, said bed having a longitudinal axis extending substantially parallel to the axis of the outer housing and said bed being curved about said axes and its length extending along said axes, gas to be purified flowing from the inlet wall to the outlet wall transversely to said axes through the catalyst bed, transverse partition means inside of said inner housing forming an internal inlet chamber, said inlet means opening into said inlet chamber, said partition means having first and second openings therein in rectilinear alignment for gas to leave the inlet chamber, inlet gas passage means extending longitudinally in the outer housing for the passage of gas from the first of said inlet chamber openings to said perforate inlet wall, longitudinally extending outlet gas passage means in said outer housing spaced transversely of the inlet gas passage means for the passage of gas from said perforate outlet wall and from the second of said openings in the inlet chamber to said outlet means, and flow control means responding to the temperature of the catalyst bed including a valve means located inside the inner housing having a rectilinearly movable valve head with two valve faces and having a first position wherein said head closes the first opening in said inlet chamber and opens the second opening thereby causing said gas stream to by-pass said catalyst bed and to flow directly from said inlet chamber to said outlet gas passage means and a second position spaced longitudinally from the first wherein said head closes the second opening in said inlet chamber and opens the first opening.

6. A catalytic converter comprising a tubular outer housing having inlet and outlet end walls respectively with inlet means and outlet means for a gas stream to be purified, an inner housing including catalyst bed means providing a catalyst bed in said inner housing and having a perforate inlet wall and a perforate outlet wall, a pair of transverse partitions in said inner housing spaced longitudinally between the inlet end wall and the catalyst bed and forming an inlet chamber between said partitions, said inlet means comprising a conduit supported in the inlet end wall delivering all inlet gas to said inlet chamber and opening into said inlet chamber, said partitions respectively having first and second rectilinearly aligned openings therein for gas to leave the inlet chamber, inlet gas passage means in the outer housing for the passage of gas from the first of said inlet chamber openings to said perforate inlet wall, outlet gas passage means in said outer housing for the passage of gas from said perforate outlet wall and from the second of said openings in the inlet chamber to said outlet means, and flow control means responding to the temperature of the catalyst bed including a valve means located inside the inner housing and having a stem extending substantially parallel to the length of the converter and supported in said inlet end wall and a single valve head having two valve faces thereon to close said openings and having a first position wherein said head closes the first opening in said inlet chamber and opens the second opening opening thereby causing said gas stream to by-pass said catalyst bed and to flow directly from said inlet chamber to said outlet gas passage means and a second position wherein said head closes the second opening in said inlet chamber and opens the first opening.

* * * * *